US009267243B2

(12) United States Patent
Kreikemeier et al.

(10) Patent No.: US 9,267,243 B2
(45) Date of Patent: Feb. 23, 2016

(54) SURFACE AND SUB-SURFACE DRAIN SYSTEM

(76) Inventors: John E. Kreikemeier, Alpharetta, GA (US); Brett Travis Long, South Lake Tahoe, CA (US)

( * ) Notice: Subject to any disclaimer, the term of this patent is extended or adjusted under 35 U.S.C. 154(b) by 643 days.

(21) Appl. No.: 13/134,842

(22) Filed: Jun. 20, 2011

(65) Prior Publication Data

US 2012/0321389 A1 Dec. 20, 2012

(51) Int. Cl.

| | |
|---|---|
| ***E02B 11/00*** | (2006.01) |
| ***E01C 13/08*** | (2006.01) |
| ***E01C 13/02*** | (2006.01) |

(52) U.S. Cl.

CPC ..... *E01C 13/08* (2013.01); *E01C 13/02* (2013.01)

(58) Field of Classification Search

CPC ..... E02B 11/005; E01C 13/02; A01G 25/06
USPC ..... 405/36, 39, 43, 48; 404/2–5, 7, 8
See application file for complete search history.

(56) References Cited

U.S. PATENT DOCUMENTS

| | | | | | |
|---|---|---|---|---|---|
| 3,626,823 | A * | 12/1971 | Toth | 404/4 |
| 4,365,911 | A * | 12/1982 | Rossberg | 405/43 |
| 4,490,067 | A * | 12/1984 | Dahowski | 404/4 |
| 4,538,386 | A * | 9/1985 | DiCello | 52/302.3 |
| 4,589,798 | A * | 5/1986 | Milly | 405/36 |
| 4,923,331 | A * | 5/1990 | Kreikemeier | 405/45 |
| 5,120,157 | A * | 6/1992 | Todd et al. | 405/36 |
| 5,495,696 | A * | 3/1996 | Repka | 52/169.5 |
| 5,501,044 | A * | 3/1996 | Janesky | 52/169.5 |
| 5,630,299 | A * | 5/1997 | Jackman et al. | 52/169.5 |
| 5,640,801 | A * | 6/1997 | Rynberk | 47/33 |
| 5,647,689 | A * | 7/1997 | Gunter | 405/36 |
| 5,653,553 | A * | 8/1997 | Gunter | 405/36 |
| 5,794,388 | A * | 8/1998 | Jackman | 52/169.5 |
| 5,803,662 | A * | 9/1998 | Gunter | 405/119 |
| 6,230,468 | B1 * | 5/2001 | Klaus | 52/741.11 |
| 6,379,078 | B1 * | 4/2002 | Zwier | 404/7 |
| 7,553,104 | B2 * | 6/2009 | Nordhoff | 405/43 |
| 7,585,555 | B2 * | 9/2009 | Stroppiana | 428/95 |
| 7,758,281 | B2 * | 7/2010 | Knox | 405/43 |
| 7,758,749 | B2 * | 7/2010 | Cook et al. | 210/170.03 |
| 7,784,217 | B2 * | 8/2010 | San Solo et al. | 47/48.5 |
| 7,810,291 | B2 * | 10/2010 | McPherson | 52/302.3 |
| 7,866,911 | B2 * | 1/2011 | Saadi et al. | 404/4 |
| 7,866,918 | B2 * | 1/2011 | Otto | 405/36 |
| 8,312,682 | B2 * | 11/2012 | Trotter | 52/302.6 |
| 2005/0042030 | A1 * | 2/2005 | Fu | 405/36 |
| 2006/0067791 | A1 * | 3/2006 | Wickens | 405/43 |
| 2007/0092337 | A1 * | 4/2007 | Nordhoff | 405/43 |
| 2008/0190045 | A1 * | 8/2008 | Janesky | 52/169.5 |
| 2009/0071070 | A1 * | 3/2009 | Solo et al. | 47/48.5 |
| 2009/0183445 | A1 * | 7/2009 | McPherson | 52/169.5 |
| 2010/0104779 | A1 * | 4/2010 | Shaneour et al. | 428/17 |
| 2011/0091281 | A1 * | 4/2011 | Cucchiara | 405/43 |

* cited by examiner

*Primary Examiner* — Doug Hutton, Jr.
*Assistant Examiner* — Patrick Lambe
(74) *Attorney, Agent, or Firm* — Nicholas J. Aquilino

(57) ABSTRACT

A water drainage system for collecting and directing water in an outdoor installation such as an artificial turf athletic field having a plurality of elongated fluid flow, edge drain conduits having an interior fluid opening therethrough and formed with a generally rectangular cross section so as to be mounted in a vertical position at the end of the artificial turf. Various drain openings, outlets and water collection apparatus are disclosed for use in the drainage system.

17 Claims, 17 Drawing Sheets

SURFACE AND SUB-SURFACE DRAIN SYSTEM

BACKGROUND OF THE INVENTION

1. Field of the Invention

The invention generally relates to perimeter drainage systems and in particular to a surface and sub-surface drain system used at the perimeter of a artificial turf sports field.

2. Description of the Related Prior Art

Typical artificial turf athletic fields often have shortcomings with drainage particularly when an artificial turf field is combined with a peripheral running track. Water accumulates at the edge of the field which is normally sloped and often covers the edge of the track. Conventional athletic fields use u-shaped drains covered with grates to drain the excess water. This arrangement only drains surface water at the top of the drain. No provision is made to disperse an accumulation of water that seeps through the turf into the underlying base.

In the known related art of drainage systems for synthetic sports fields there are no commercially feasible systems for construction perimeter drain systems. U.S. patent application 2008/001756 by Cook et al discloses a drainage filtration system for use in a synthetic sport field. The drainage and filtering system of Cook fails to provide a means of clearing drains or an economical means of integrating the system with a perimeter curb system typically found in a sports arena.

U.S. Pat. No. 4,067,757 by Layman provides an elongated retainer strip to secure synthetic turf in place but fails to provide an integration of drainage and turf retention. The turf retainer strip by Layman fails to provide any drain cleanouts or perimeter gutters.

U.S. Pat. No. 5,976,645 by Daluise et al presents a vertical draining system for synthetic turf but fails present water gutters or water valleys, washouts for drains or even real surface drainage.

U.S. Pat. No. 6,598,360 to Pratt and U.S. Pat. No. 5,501,044 to Janesky show prior art examples of rectangular drain conduits.

BRIEF SUMMARY OF THE INVENTION

The system of this invention can be used in any outdoor structures and environments where drainage needs to be addressed, although it is specifically useful in artificial turf athletic fields. Specifically the invention addresses drainage of not only surface water but also accumulation of water on an adjoining running track and subsurface water that seeps under the artificial turf field. The present system improves the related art systems by providing a configuration of drainage components for perimeter surface drainage of sport fields at the edge of the artificial turf. Unlike the related art, the present invention provides an efficient and economic drainage system that may be applied next to or upon a perimeter curb structure and may also be installed as a stand alone drainage and surface edge system. Thus, the present invention achieves new efficiencies in construction as additional pours of concrete are not required. Other qualities of the invention present a reduction is site excavation and the typical amount of hardware associated with prior art drainage systems.

The disclosed surface drainage system may be premade within a factory setting, shipped in various lengths and configurations and may be made from a variety of materials. Typically the drain members are made of PVC plastic and provide a measure of flexibility to provide flexible drain embodiments able to comport with compensate for variances in the structure of the installation site such as curved curbs, walls and other structures. The drain member provides both a drain mechanism and a fastening ledge for the securing of turf products, sport and play surfaces and other surface and covering materials.

A first preferred embodiment of the invention is an edge drain member for use at the edge of an artificial turf athletic field environment. The drain member is formed as a generally rectangular tube open in the center to accommodate reception and flow of water and associated debris located in a vertical position at the edge of the artificial turf athletic field. One side of the vertical sides of the tube is generally flat in order to conform to a concrete curb or similar supporting structure when applicable. The opposite side is formed with a ledge configuration to provide a nailing surface for the turf, stake holes and suitable drain holes at a lower edge of the ledge configuration to drain water out of the interior body of the drain. The top surface includes a series of track drainage holes spaced along the length of the drain member positioned to receive drainage water at the edge of the turf. The drain member further includes turf and turf drainage composite openings located just above the ledge configuration on an upper side surface of the drain member. The lower portion of the drain member serves as a bottom collection to collect debris and drainage water.

In an athletic field location, a plurality of edge drain members are installed, with the length of each drain member being determined by the amount of drainage assessed for the particular location. A series of catch basins are located adjacent the ends of the drain members to accumulate water and debris waste for subsequent evacuation to a drainage location. The size and shape of the catch basins correspond to the shape of the drainage members and are connected thereto by a suitably shaped clip member. Preferably the drainage members and the catch basins are spaced slightly to allow for expansion and contraction of the system without damage thereto.

Various additional embodiments of the above described invention include, but are not limited to, a variety of drain structures attached to the drain system as well as a variety of installation structures and are described hereinbelow.

A second preferred embodiment of the invention is an edge drain member is formed of an elongated member, generally rectangular in cross section, with sides and an upper and lower surface positioned vertically at the edge of an artificial turf athletic field. The drain member includes a frontal side, a rear side, a top and bottom. In this embodiment the elongated drain member is solid and is formed with a series of intermittently spaced, open vertical drain slots between the top extending to the bottom and located along the length the flexible drain member. In preferred embodiments, a sediment channel runs longitudinally near the bottom of and along the entire length of the drain member.

Various embodiments may include a groove formed along the length of the flexible drain member on the rear side thereof opposite the sediment channel to accommodate and locate a flat drain placed within the groove along the length of the flexible drain. The flat drain provides flow channels for water and drainage material. Side outlet holes create a flow path between the flat drain and the sediment channel to capture overflow therefrom.

Another embodiment uses a series of sediment catch or catch basins located between and connecting, in line, with two adjacent drain members. The catch basins may have relatively large sediment catch voids such that larger objects fall into the sediment catch and thus do not block the vertical drains along the flexible drain member. The sediment catch or catch basin may be used as an access point for clearing the contents of the sediment channel.

As with the first embodiment, a variety of drain attachments and installation configurations may be used to conform to the particular drainage requirements and structural differences of the installation site.

A third embodiment uses an edge drain in combination with a flexible flat drain to direct excess water directly into sub-surface soil and/or directly into a sub-surface drain pipe.

A primary object of the present invention is to provide a drain system structured to be used at the edge of an artificial turf athletic field.

Another object is the provision of a drain system to relieve standing water on an athletic field after heavy rain to prevent damage to the field.

Still another object is the provision of a drain system for an athletic field to allow collected water to immediately drain preventing undue accumulation of water on playing areas.

These and other objects and advantages will be made apparent when considering the following detailed specification when taken in conjunction with the drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Figure 1:
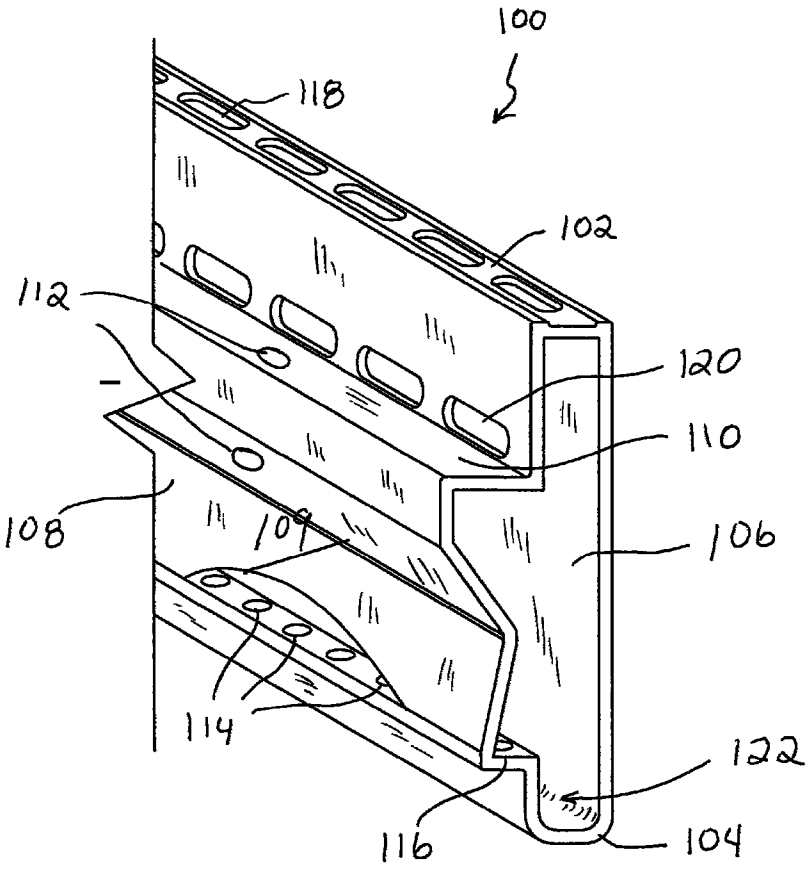
FIG. 1 is a partial perspective view of a first embodiment of the invention.

FIG. 1 illustrates first preferred embodiment of an edge drain member 100 in accordance with the invention. The drain member 100 is formed as an elongated fluid flow conduit formed of walls and an opening having a generally rectangular cross section. The opening in the drain member 100 accommodates the flow of water and associated debris when it is located in a vertical position at the edge of the artificial turf athletic field. The shorter axis of the rectangular cross section of said drain member 100 is formed by a top wall 102 and bottom wall 104 on opposite upper and lower ends of the conduit. The longer axis of said rectangular cross section is formed by a first straight or flat side wall 106 and an opposite second side wall 108 formed with a raised or bulged area 109 extending outwardly from second side wall 108. The flat side wall 106 of the drain member 100 conforms to a concrete curb or similar supporting structure when applicable or stands alone against suitable fill material. The bulged area 109 includes an upper ledge configuration 110 to provide a nailing surface for the artificial turf and/or turf draining composite. Stake holes 112 are provided to allow the drain member 100 to be supported by stakes when used in a free standing position. Suitable drain holes 114 are formed at a lower ledge 116 of the bulged area 109 to drain water out of the interior of the drain member 100. The top wall 102 includes a series of track drainage holes 118 spaced along the length of the drain member 100 positioned to receive drainage water at the edge of the artificial turf and track surface. The drain member 100 further includes turf and turf drainage composite openings 120 located just above the ledge configuration 110 on an upper area of the side surface 108 of the drain member 100. The lower portion of the drain member 100 serves as a bottom collector 122 to collect debris and drainage water flowing through the drain member 100.

Figure 2:
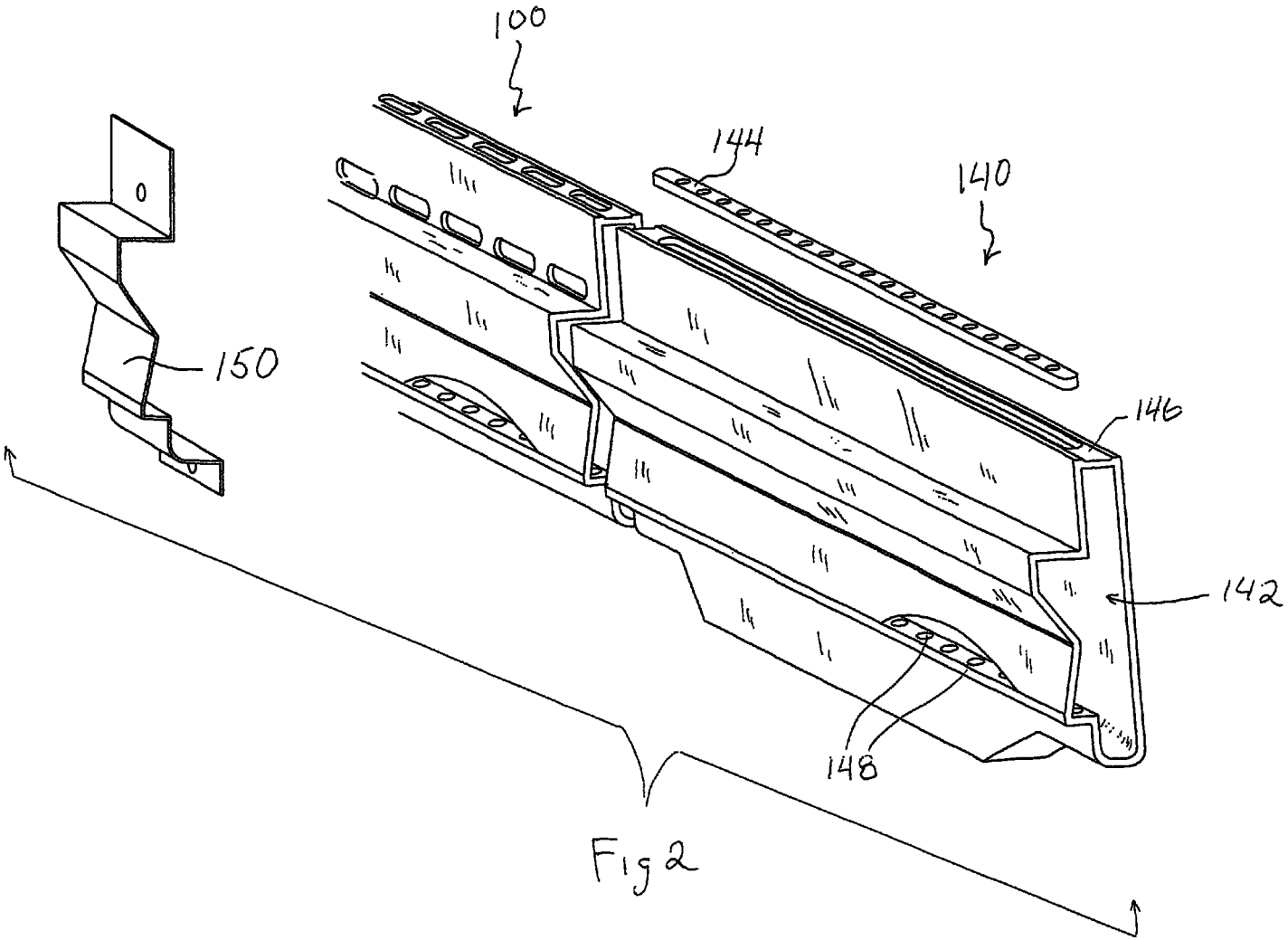
FIG. 2 is a partial, exploded, perspective view of the drain member of the invention in combination with a catch basin.

In an athletic field location, a plurality of edge drain members 100 are installed around the entire perimeter of the field, with the length of each drain member being determined by the amount of drainage normally required for that particular location. Referring to FIG. 2, a drain member 100 is shown positioned adjacent a catch basin 140 in an in-line relationship. For illustrative purposes only one drain member 100 and one catch basin 140 are shown, however it will be appreciated that at an actual location site, there would be a plurality of drain members 100 and a corresponding number of catch basins 140 located between and adjacent the drain members 100. The catch basins 140 accumulate water and debris waste for subsequent evacuation to a remote drainage location. The catch basin 140 is formed in the same configuration as the drain member 100 as seen at the end 142 thereof. A cover 144 is removable from the top 146 of the catch basin 140 to facilitate cleaning of debris that may accumulate in the bottom of the catch basin. Drain holes 148 allow drainage of excess water from the catch basin 140. As seen in FIG. 2, the size and shape of the catch basins 140 correspond to the shape of the drainage members 100 and are connected thereto by a suitably shaped clip member 150. Preferably the drainage members 100 and the catch basins 140 are spaced slightly to allow for expansion and contraction of the system without damage thereto. The length of the drain members 100 and consequently the distance between catch basins 140 will vary depending upon the drainage needs of the location site.

Surface water on the artificial turf generally drains toward the edges of the field because of a gentle slope in the direction of the sides and ends of the athletic field. Surface water also penetrates through the turf mat into the underlying turf drainage composite. Water also drains from a peripheral track to the drain members 100. Using the described drain member 100, in a drainage system, water will flow through the track drainage holes 118 on the top wall of the drainage member 100. This water flows into the interior of the conduit and accumulates in the bottom collector 122. Trash and debris typically collects in the collector 122 and are flushed to the catch basins 150 with water from a first flush of rainfall. During a heavy rainfall the water level in collector 122 rises above the shelf 116 and drains out of the holes 114 without having to flow a long distance to a catch basin 150. Additional water that has seeped through the artificial turf and into turf drainage composite drains through drainage openings 120. Various additional embodiments of the above described invention include, but are not limited to, a variety of drain structures attached to the drain system as well as a variety of installation structures.

Figure 3:
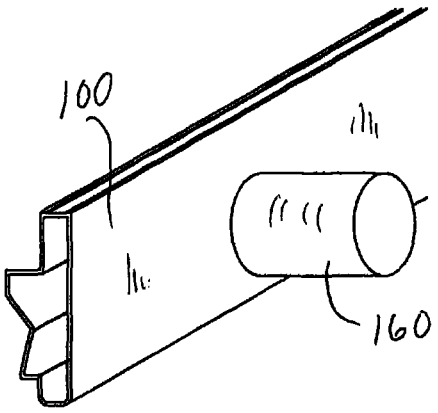
FIG. 3 is a rear perspective view of the drain member of the invention with a pipe drain in the foreground.

For example, FIG. 3 illustrates a drain member 100 with an additional pipe fitting 160 attached to an opening (not shown) the flat side 106 of the drain member 100 for making connections to a drain structure outside the field.

Figure 4:
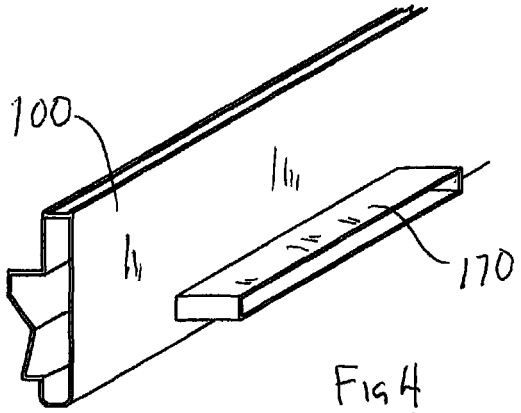
FIG. 4 is a rear perspective view of the drain member of the invention with a flat drain connector in the foreground.

FIG. 4 illustrates a similar external drain structure wherein a flat drain fitting 170 is attached to the drain member 100 for connection to a flat drain.

Figure 5:
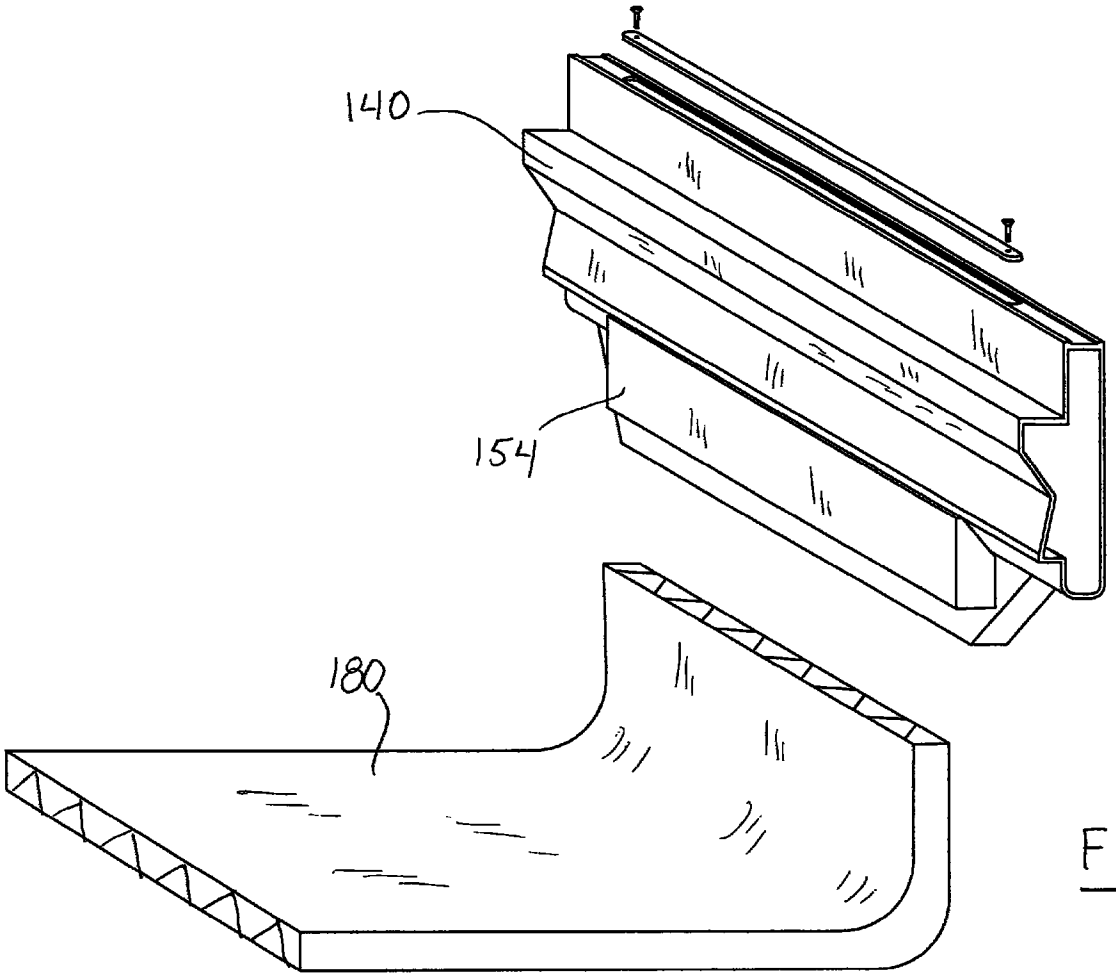
FIG. 5 is a perspective view of a catch basin and flat drain of the invention.

FIG. 5 illustrates a catch basin 140 having a vertical fitting 154 for connection with an external flat drain 180 to transfer water to a sideline drain pipe (not shown).

Figure 6:
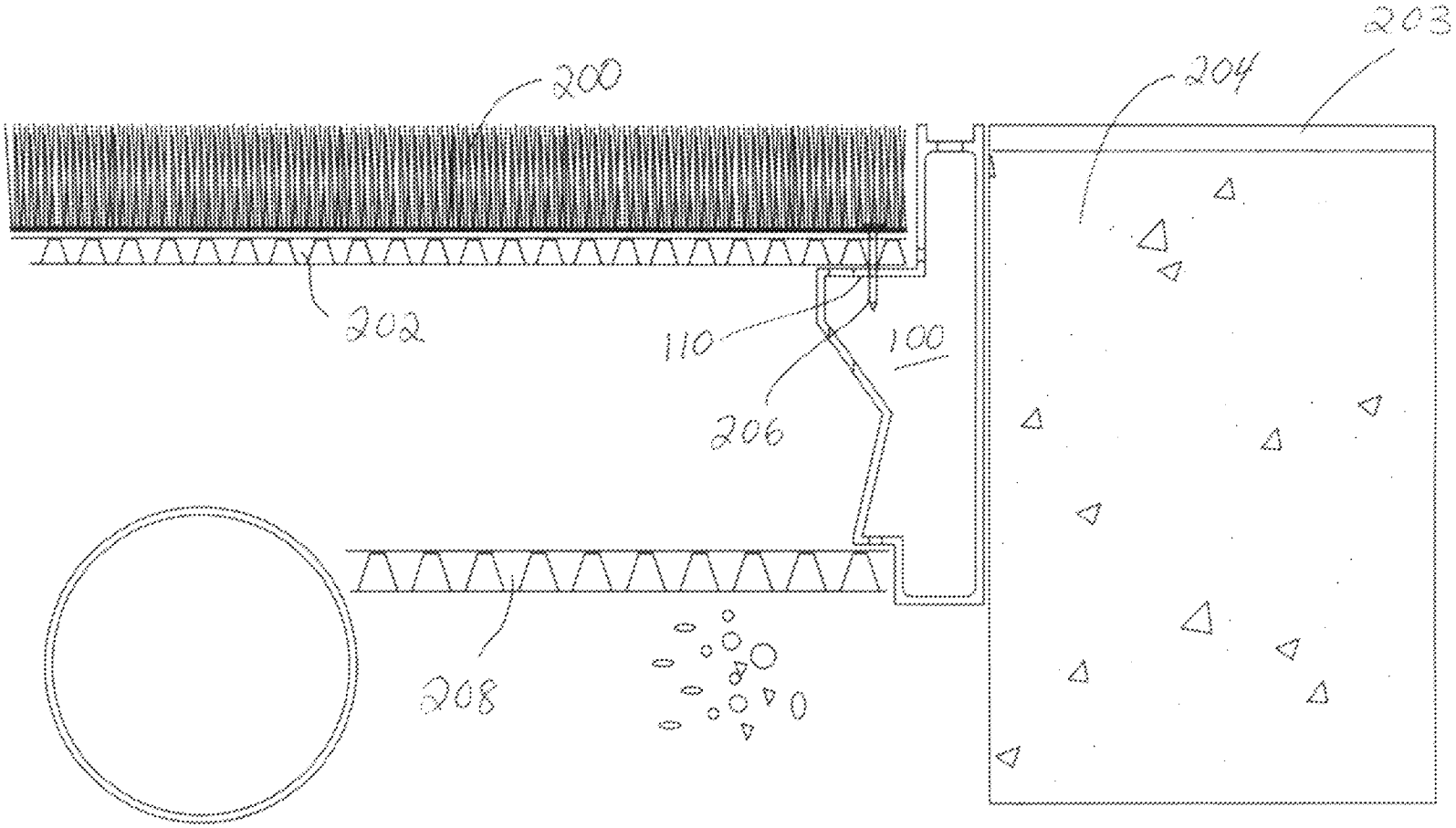
FIG. 6 is an elevational view of the drain member in a typical artificial turf installation site.

FIG. 6 illustrates a drain member 100, as seen in an end view, positioned at the edge of an artificial turf mat 200, an underlying turf drainage composite layer 202 and a peripheral running track 203. The outer side of the drain member 100 is positioned abutting a concrete curb 204. The turf 200 is fastened to the ledge 110 of the drain member 100 by a nail 206 or similar fastening device. Another underlying layer of flat drain 208 lies adjacent the bottom edge of the drain member 100.

Figure 7:
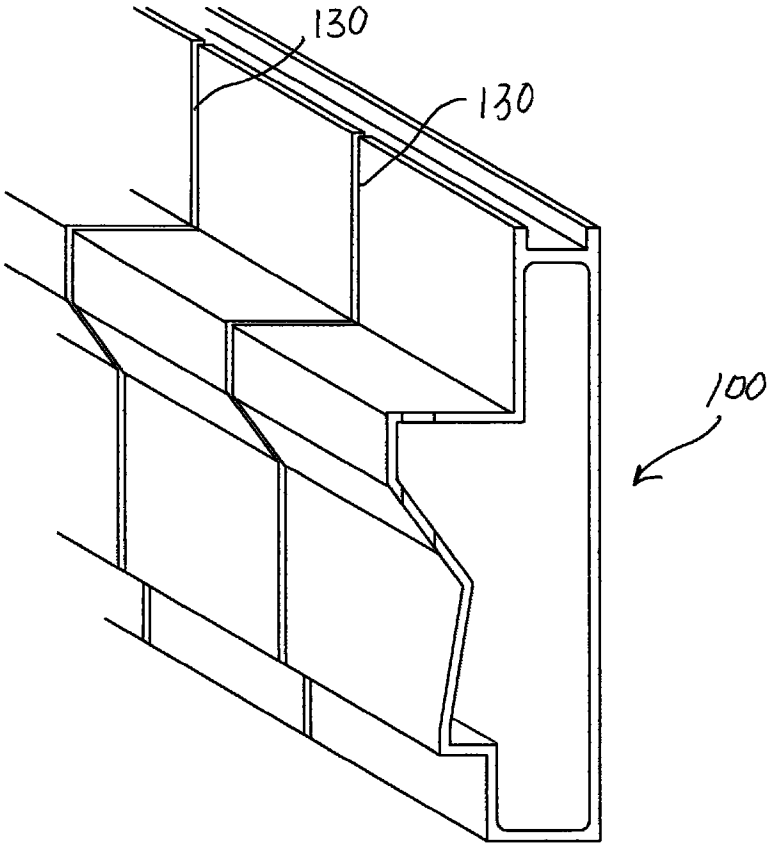
FIG. 7 is a front perspective view of another embodiment of the invention.

FIG. 7 shows a variation of a drain member 100 and includes a series of cuts 130 spaced along the inner longitudinal side 108. The cuts 130 provide a greater degree of flexibility and allow the drain member 100 to be bent more easily to better conform to an installation at a location that may not be totally flat.

Figure 8:
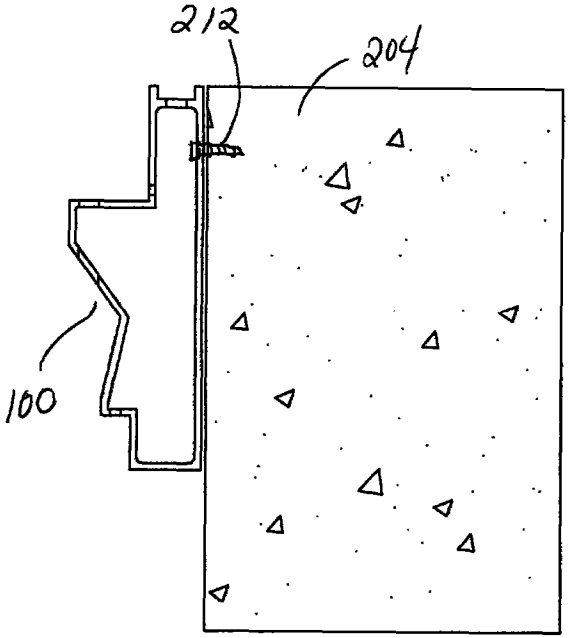
FIG. 8 is an elevational view of a drain member attached to a concrete curb.

FIG. 8 shows a drain member 100, also seen in an end view, in abutment with a concrete curb 204. The drain member 100 is preferably fastened to the curb 204 with a concrete screw 212.

Figure 9:
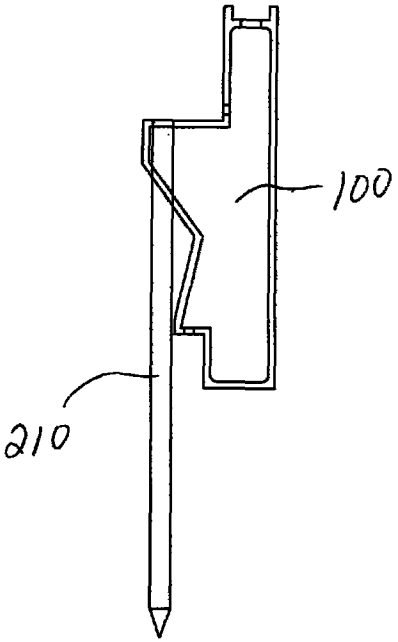
FIG. 9 is an elevational view of a drain member in combination with a ground support stake.

FIG. 9 presents another end view of a drain member 100 and a ground engaging stake 210.

Figure 10:
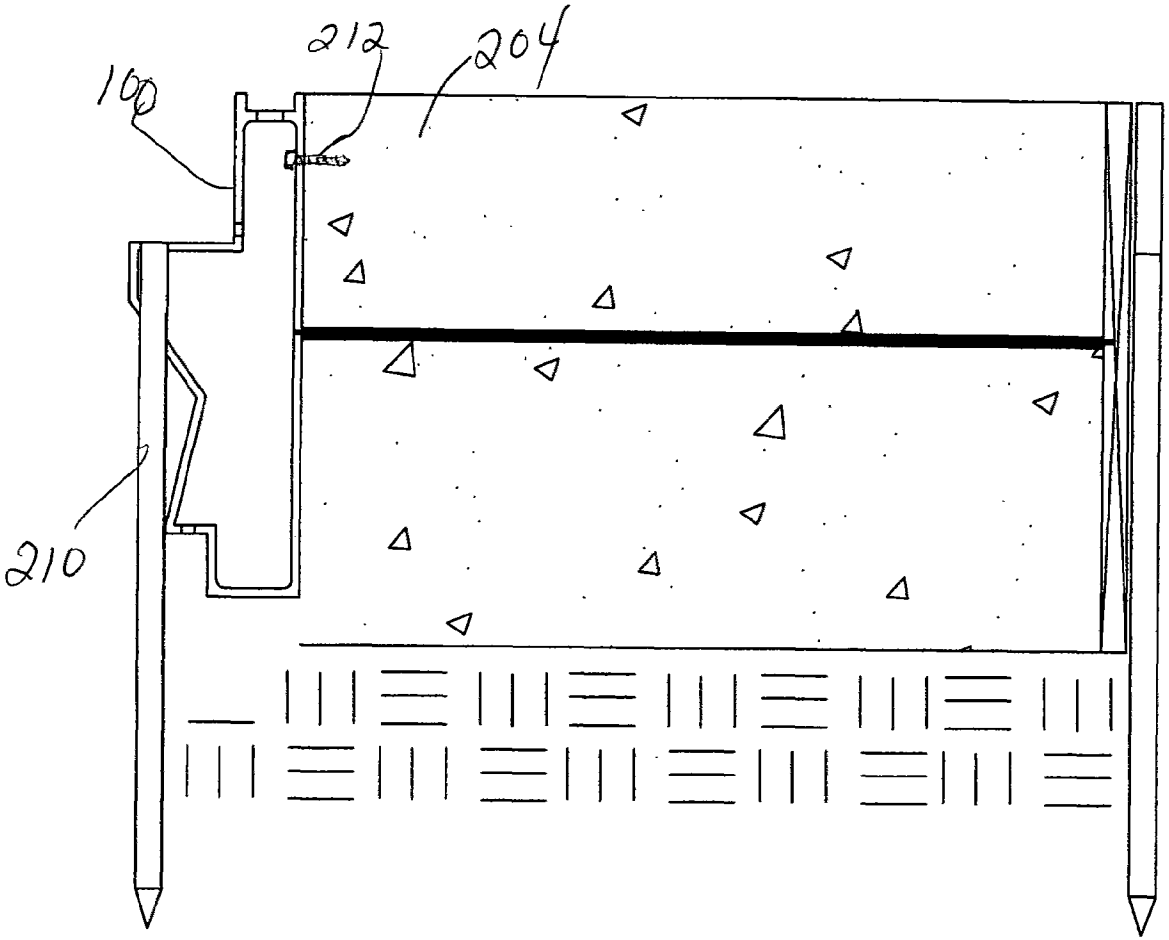
FIG. 10 is an elevational view of a drain member at an installation site.

FIG. 10 shows still another end view of a drain member 100 secured by a ground stake 210 and attached to a concrete form 214 by a connector 216 to facilitate placement of the concrete curb 204. The drain member 110 may also be secured to the curb 204 with a concrete screw 212.

Figure 11:
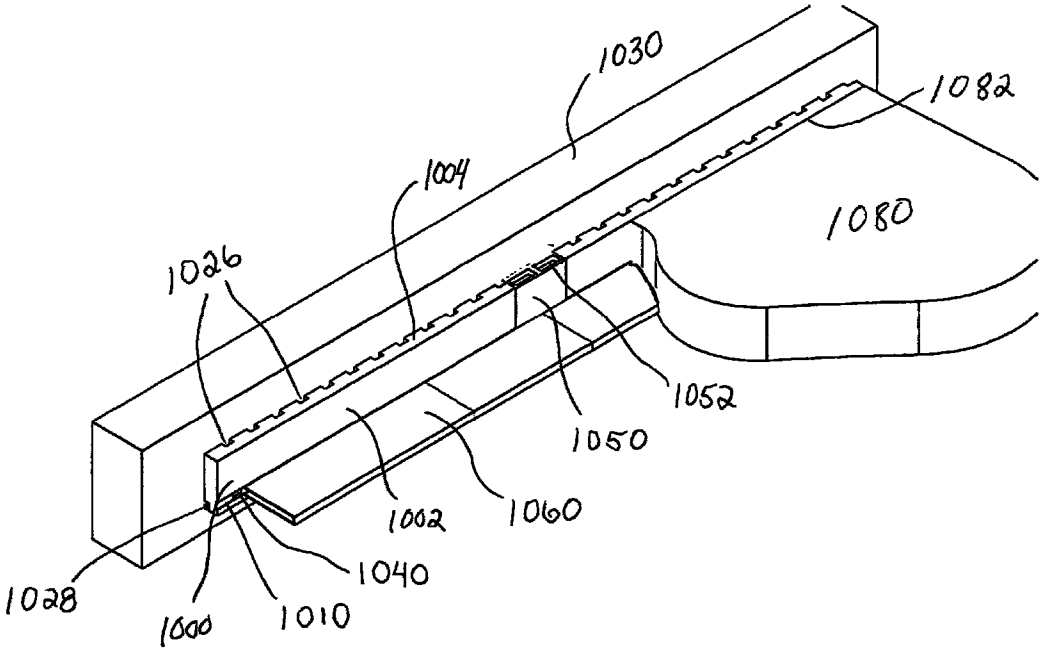
FIG. 11 is a perspective view of another embodiment of the invention.
Figures 12, 13:
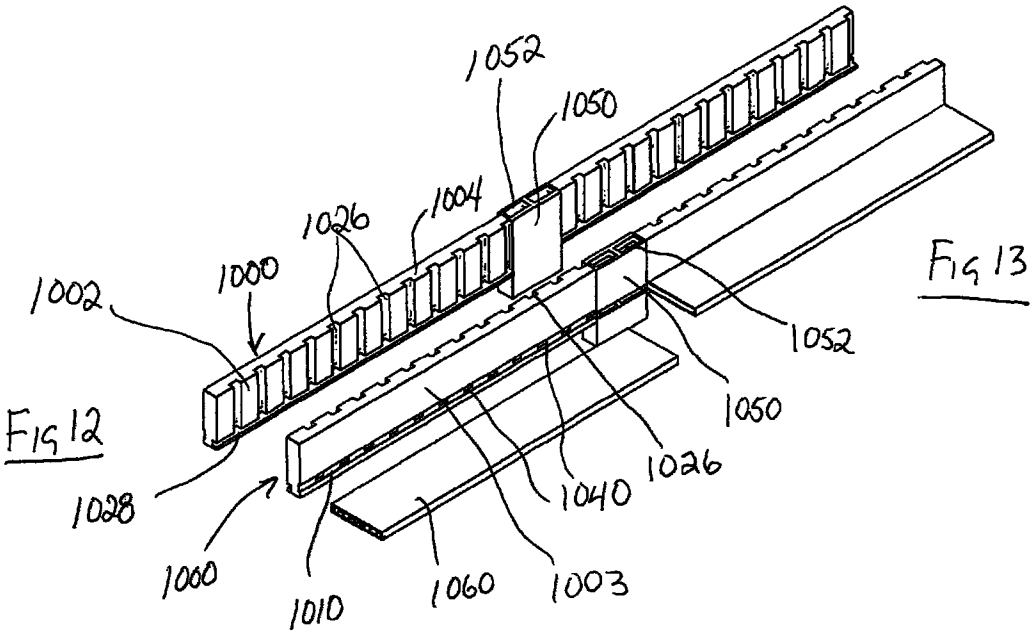
FIG. 12 is a front perspective view of another embodiment of the invention.
FIG. 13 is a back perspective view of the embodiment of FIG. 12.

FIGS. 11, 12 and 13, show another preferred embodiment of a sub-surface drainage system of the present invention is disclosed that is used in place along the periphery of an artificial turf field. An edge drain member 1000 is formed with an elongated, generally horizontal configuration from plastic PVC or similar material. Preferably the drain member 1000 is at least partially flexible to accommodate variances in the location site structures such as a concrete retainer curb. FIG. 12 is a frontal view of the flexible drain member 1000 from the perspective of standing upon the curb and looking to the center of the playing field. FIG. 13 is a rear view of the flexible drain member 1000 and also discloses a flat drain 1060 attached to a flexible drain member 1000.

The flexible drain member 1000 includes a frontal side edge 1002 and a rear side edge 1003 and a top edge 1004. It will be appreciated the bottom edge, not shown, is a mirror image of the top edge 1004. The flexible drain member 1000 is formed with a series of open vertical drain 1026 slots formed within the frontal side edge 1002 between the top edge 1004 extending to the bottom edge. The drain slots 1026 are positioned in a vertical direction relative to the horizontal length of the flexible drain member 1000. The drain slots 1026 are positioned intermittently and located along the length the flexible drain member 1000. A concrete curb 1030 abuts against the frontal side 1002 of the flexible drain member 1000 and defines a closure side of the vertical drain slots 1026. A sediment channel 1028 runs along the length of the flexible drain member 1000 at the bottom thereof. A sediment catch or catch basin 1050 is located between and connects two flexible drain members 1000 and may have relatively large sediment catch voids 1052 such that larger objects fall into the sediment catch 1050 and thus do not block the vertical drains 1026 along the flexible drain member 1000.

A groove 1010 is formed along the length of the flexible drain member 1000 on the rear side 1003 of the flexible drain member 1000 opposite the sediment channel 1028 to locate the flat drain 1060 placed within the groove 1010 along the length of the flexible drain 1000. The flat drain 1060 is generally u-shaped thereby being open in the middle to provide a flow channel for drainage material. The relative elevation of the flat drain 1060 is higher than the bottom of the sediment channel 1028. Side outlet holes 1040 create a flow path between the flat drain 1060 and the sediment channel 1028 to capture overflow therefrom. The sediment catch or catch basin 1050 may be used as an access point for clearing the contents of the sediment channel 1028.

In the present embodiment, an impervious surface 1080 of an athletic field, for example, is shown with an outer drain edge 1082 lying upon the flat drain 1060 and abutting the flexible drain member 1000. The top surface of the impervious surface 1080 may be sloped so as to cause fluid to drain toward the flexible drain member 1000. The drain edge 1082 of the impervious surface or interior surface may be level with or just higher than the top edge 1004 of the flexible drain member. The impervious surface 1080 may support a covering such as a synthetic turf carpet.

In this embodiment, water and other material to be drained striking the top of the impervious surface 1080 flows toward the perimeter of the sport field; that is toward the curb 1030. After reaching the drain edge 1082 of the impervious surface 1080, the water may enter any of the vertical drain channels 1026 at the top 1004 of the flexible drain member 1000, fill the sediment channel 1028 and then spill into the flat drain 1060. The flat drain 1060 may empty into further drain inlets. This embodiment may also be used without flat drain 1060, wherein water may enter into adjacent gravel and travel to an external drainage pipe (not shown).

Figure 14:
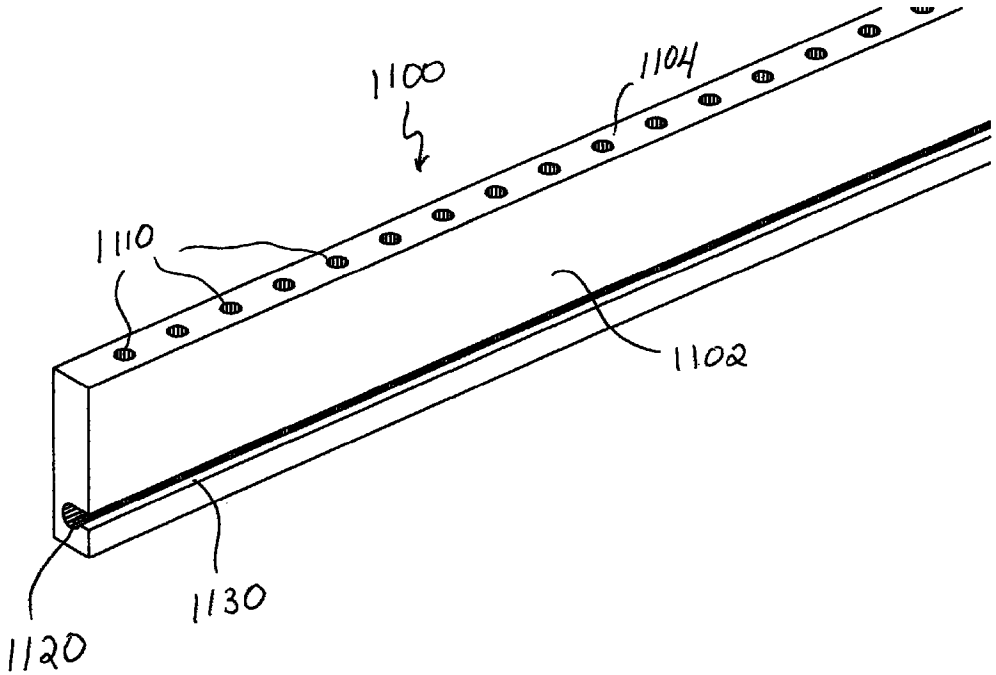
FIG. 14 is a perspective view of still another embodiment of the invention.

FIG. 14 shows an alternate embodiment of a flexible drain member 1100 of the type disclosed with reference to the sub-surface drainage system shown in FIGS. 11, 12 and 13. The flexible drain member 1100 is generally rectangular in cross section and includes side surfaces 1102, a top surface 1104 and bottom surface, not shown. The flexible drain member 1100 is formed with vertical drain openings 1110 leading into an interior drain channel 1120 having an open side outlet slot 1130. The drain openings 1110 are shown as being cylindrical but any shape configuration or size is readily interchangable. Likewise the length, width and height of the flexible drain member 1100 may be varied to accommodate a particular usage site location.

Figure 15:
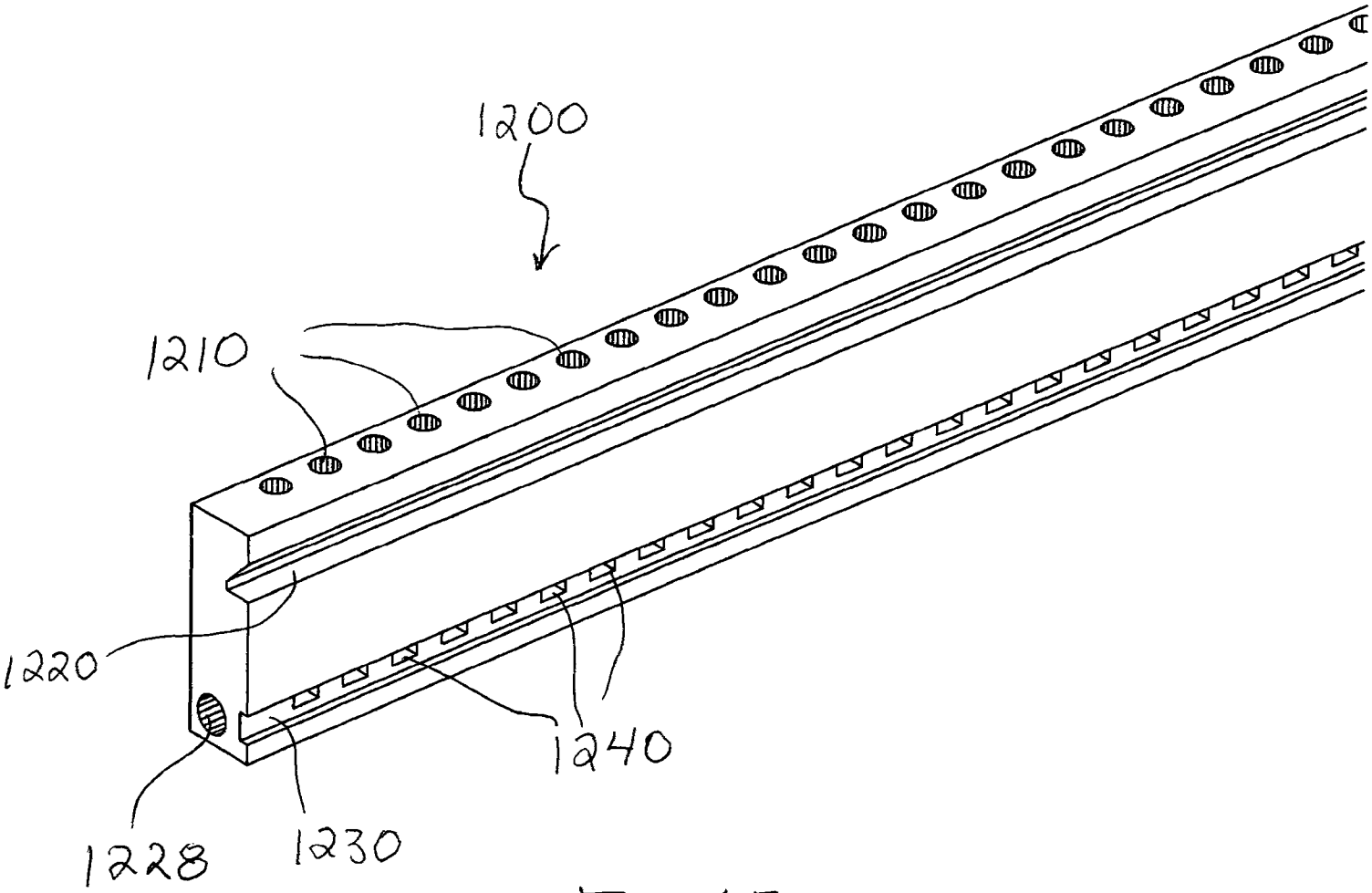
FIG. 15 is a perspective view of yet another embodiment of the invention.

FIG. 15 shows another embodiment of a flexible drain member 1200 for installation with or without a curb. The flexible drain member 1200 is formed with enclosed vertical drain voids 1210 not needing a curb or wall. This embodiment features a ledge or void 1220 useful for nailing, stapling, gluing or otherwise attaching synthetic turf or other material formed on a side 1202 of the flexible drain member 1200. An interior sediment channel 1228 extends the length of the flexible drain member 1200. Side outlet holes 1240 open to an elongated groove 1230 and are in fluid communication with the sediment channel 1228. The outlet holes 1240 are generally perpendicular to the sediment channel 1228 to allow flow of water from the sediment channel 1228 to a suitable outlet drain (not shown).

Figures 16, 17:
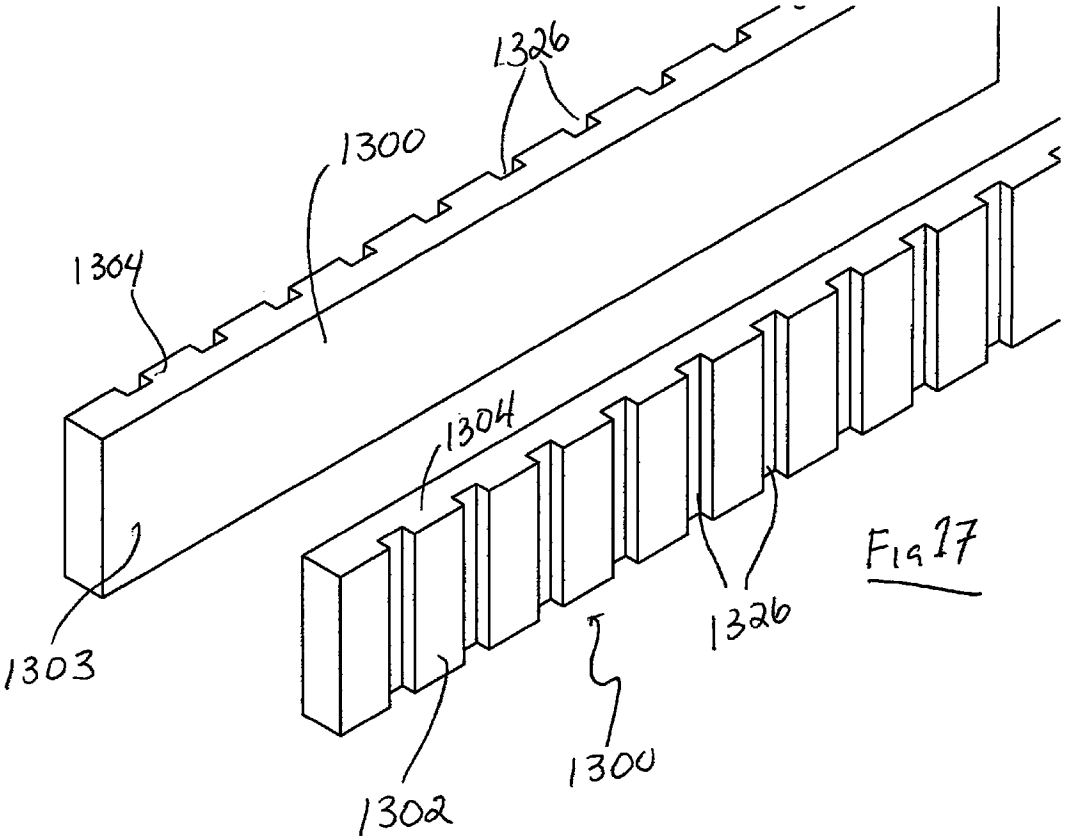
FIG. 16 is a rear perspective view of another embodiment of the invention.
FIG. 17 is a front perspective view of the embodiment of FIG. 16.

FIGS. 16 and 17 show front and rear views of still another embodiment of a basic flexible drain member 1300 formed as an elongated, length of material with a rectangular cross section. The drain member 1300 has a front side 1302, a rear side 1303, top 1304 and bottom being a mirror image of the top 1304. Vertical drainage slots 1326 are spaced along the length of the flexible drain member 1300. No other drain channels are used in this embodiment.

Figures 18, 19:
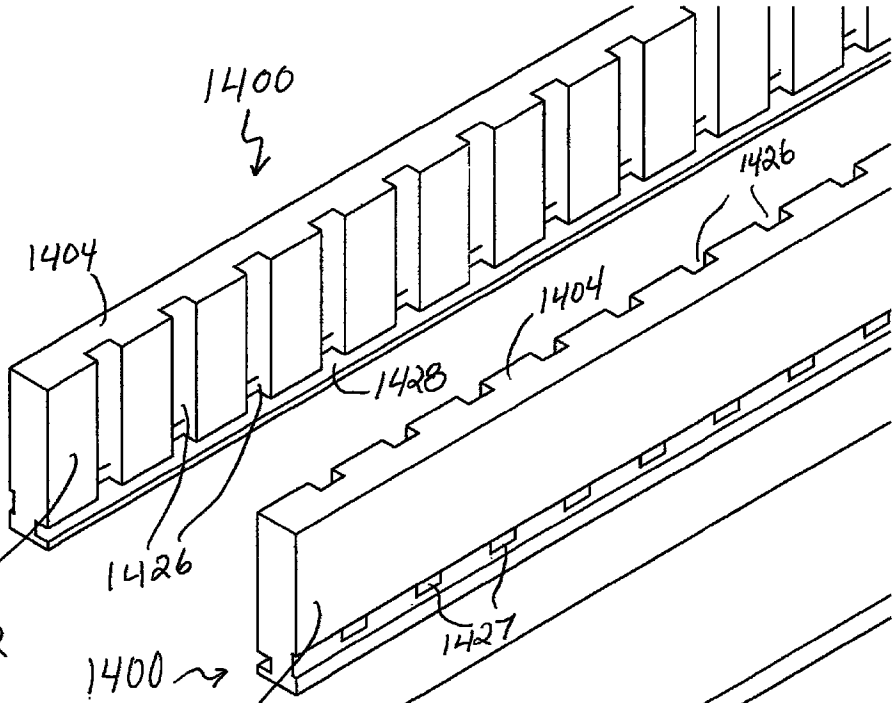
FIG. 18 is a front perspective view of another embodiment of the invention.
FIG. 19 is a rear perspective view of the embodiment of FIG. 18.

FIG. 18 and FIG. 19 show front and rear views of yet another embodiment of a basic flexible drain member 1400 formed with an elongated, rectangular cross section with a front side 1402, a rear side 1403, top 1404 and bottom being a mirror image of the top 1404. The flexible drain member 1400 is formed with open vertical drain openings 1426 spaced along the length of the flexible drain member 1400 and a sediment channel 1428. The vertical drain openings 1426 and the sediment channel 1428 are connected in fluid communication by a plurality of side outlet holes 1427 located along the entire length of the flexible drain member 1400. The open vertical channels 1426 may be of various sizes and shapes. A flat drain 1460 is in fluid communication with the side outlet holes 1427.

Figure 20:
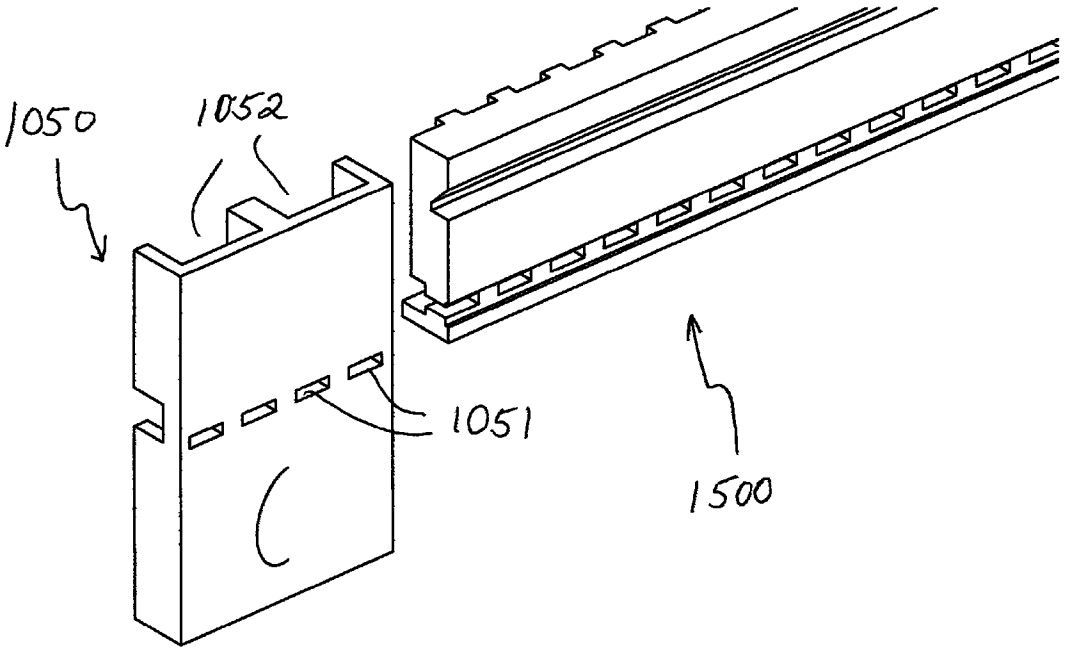
FIG. 20 is a perspective view of a catch basin used in the invention.

FIG. 20 presents a detailed view of a sediment catch or catch basin 1050 of the type shown in the embodiment of FIGS. 11-13 adjacent a drain member 1500. The catch basin 1050 is formed with sediment catch voids 1052 and with sediment catch outlets 1051. The sediment catch or catch basin 1050 may be covered with a removable top grate (not shown) to allow access for cleaning residual debris not drained.

Figure 21:
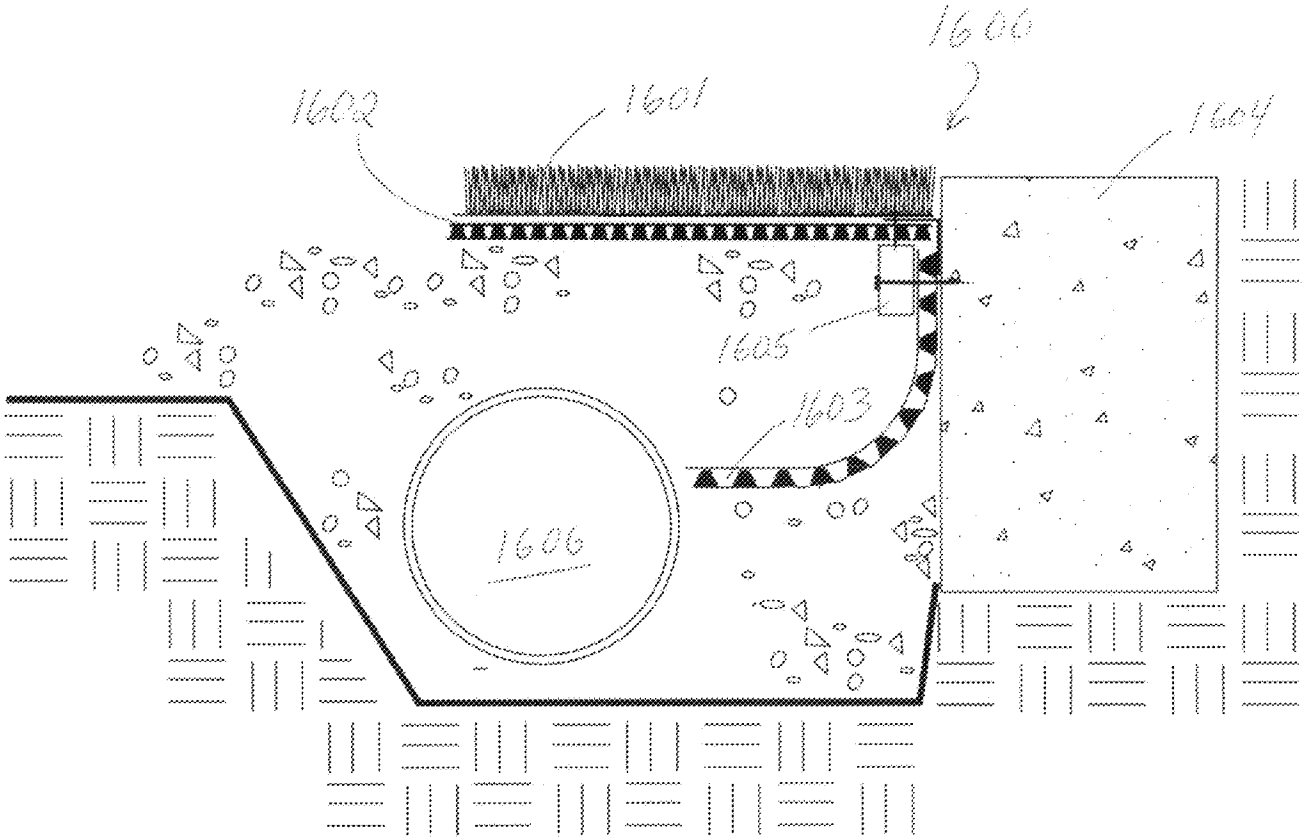
FIG. 21 illustrates still another embodiment of an edge drain system in accordance with the present invention.

FIG. 21 shows another edge drain system 1600 for an artificial turf mat 1601 and an underlying drainage composite material 1602. The system 1600 uses a flexible flat drain 1603 inserted at the edge of the artificial turf mat 1601 and drainage composite 1602 just below the interface with a concrete support curb 1604. The upper end of the flexible flat drain 1603 is positioned between a turf nailing mounting block 1605 and the concrete curb 1604 to capture water at this location. The flexible flat drain 1603 drains excess water directly from the edge of the turf mat 1601 into the sub-surface and or into a sub-surface drain such as a perforated pipe 1606.

Figure 22:
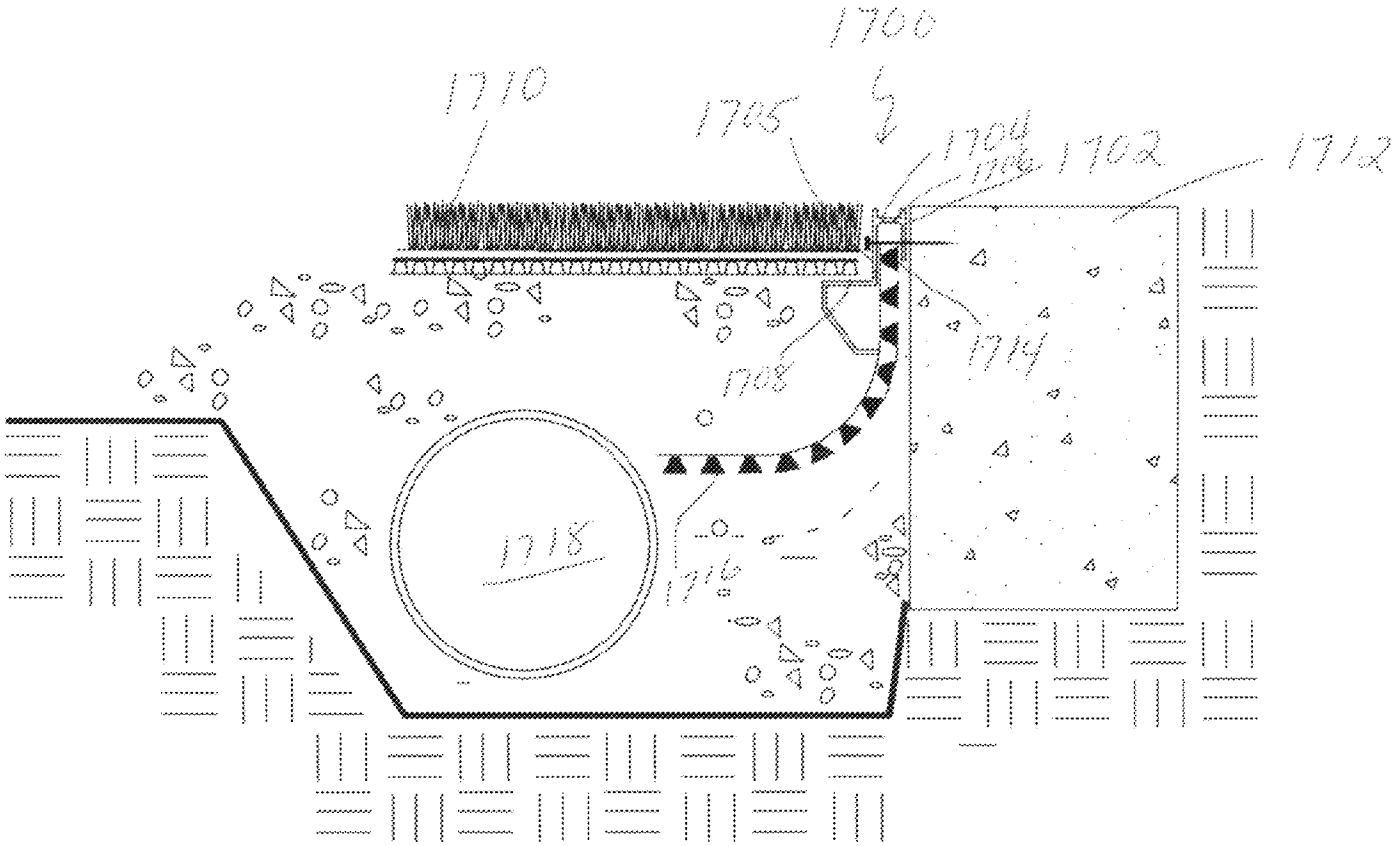
FIG. 22 illustrates a variation of the edge drain system of FIG. 21.

FIG. 22 is a variation of the system of FIG. 21. In this embodiment an edge drain system 1700 uses a longitudinal, u-shaped drain member 1702 with an upper surface 1704 and sides 1705 and a series of drain openings 1706 in the upper surface 1704. A turf nailer shelf 1708 is formed at and extends from a lower edge of one of the sides 1705 and provides a support where the edge of the turf mat is nailed. The drain member 1702 is positioned between the edge of the artificial turf mat 1710 and a concrete support curb 1712. The upper edge 1714 of a flexible flat drain 1716 is located within the interior of the u-shaped drain member in fluid communication with the drain openings 1706 to collect water draining therethrough. The flexible flat drain 1716 drains water directly into the sub-surface or into a sub-surface drain 1718.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. The teachings of the invention provided herein can be applied to other drainage systems, not only the systems described herein. The various embodiments described herein can be combined to provide further embodiments. These and other changes can be made to the invention in light of the detailed description.

Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

The invention claimed is:

1. A system of water drainage for an outdoor artificial turf installation comprising:

a plurality of water drainage conduits defined by each being an elongated structure having an interior fluid opening therethrough and formed with a generally rectangular cross section, the longer axis of said rectangular cross section being defined by side walls; said longer axis disposed in a vertical direction in said outdoor installation; a shorter axis of said rectangular cross section defined by a top wall at the top of said conduit and a bottom wall at the bottom of said conduit opposite said top wall; one of said side walls being generally flat and a second of said walls having a bulged area, extending outwardly from said second of said side walls; said bulged area including a flat nailing surface generally parallel to said top wall; said flat nailing surface being horizontal in said outdoor installation; a plurality of openings on said top wall permitting fluid flow therethrough from said top wall into the interior opening of said drainage conduit; a plurality of lower drain openings located adjacent said bottom of said conduit;

a series of catch basins disposed between ends of each of said drainage conduit and in line therewith; said catch basins including at least one drainage outlet in order to drain water and accompanying debris material to a location remote from said artificial turf installation.

2. The system of claim 1 further defined by a removable top on said catch basin to provide interior access to said catch basin for cleaning thereof.

3. The system of claim 1 further defined by a drainage fitting connected to said catch basin for making connection to the exterior of the field.

4. The system of claim 3 wherein said fitting is a pipe.

5. The system of claim 3 wherein said fitting is a flat drain.

6. The system of claim 3 wherein said fitting is disposed in a vertical direction and attached to an external drain.

7. The system of claim 1 wherein said catch basin is configured with a cross sectional configuration that matches the cross sectional configuration of said water drainage conduits to enable an in-line connection insuring uninterrupted flow therebetween.

8. The system of claim 1 further including a connector clip between ends of said drainage conduit and said catch basin.

9. The combination of an athletic field formed of artificial turf and a drainage system therefor comprising:

a water drainage conduit at the edge of said artificial turf athletic field; said conduit defined as an elongated structure having an interior opening to accommodate fluid flow therethrough with a generally rectangular cross section;

the longer axis of said rectangular cross section of said conduit being defined by side walls disposed in a vertical direction relative to the surface of said artificial turf athletic field;

the shorter axis of said rectangular cross section of said conduit being defined by a top wall at the top of said conduit and a bottom wall at the bottom of said conduit opposite said top wall;

at least one of said side walls of said conduit having a bulged area extending outwardly from said interior opening of said water drainage conduit; said bulged area of said one of said side walls including a flat nailing surface in the form of and serving as a ledge generally parallel to and below said top wall and said surface of said artificial turf athletic field to support edge areas of said artificial turf;

a plurality of openings in said top wall permitting fluid flow therethrough into the interior of said interior opening of said drainage conduit;

and, a plurality of lower drain openings adjacent said bottom of said conduit.

10. The combination of claim 9 further including stake holes in said bulged area to locate support stakes therein.

11. A water drainage conduit for collecting and directing water in an outdoor artificial turf installation comprising:

an elongated structure located adjacent edge areas of said outdoor artificial turf installation and having an interior fluid opening therethrough formed with a generally rectangular cross section, the longer axis of said rectangular cross section being defined by side walls; said longer axis disposed in a vertical direction in said outdoor artificial turf installation; a shorter axis of said rectangular cross section defined by a top wall at the top of said conduit and a bottom wall at the bottom of said conduit opposite said top wall; one of said side walls being generally flat and a second of said walls having a bulged area, extending outwardly from said second of said side walls; said bulged area including an upper flat nailing ledge below and generally parallel to said top wall; said flat nailing surface being horizontally disposed to provide a nailing surface for said edge areas of said artificial turf installation; a plurality of openings on said top wall permitting fluid flow therethrough from said top wall into the interior opening of said drainage conduit; a plurality of lower drain openings located adjacent said bottom of said conduit; a collection trough at said bottom of said conduit for collection of water and debris flowing through said conduit; said lower drain openings further defined as being located above said collection trough and formed on a lower ledge of said bulged area; and, an additional series of drain openings located adjacent to and above said nailing surface ledge.

12. A water drainage conduit system for collecting and directing water in an outdoor installation comprising: a plurality of water drainage conduits defined by each being an elongated structure having an interior fluid opening therethrough and formed with a generally rectangular cross section, the longer axis of said rectangular cross section being defined by side walls; said longer axis disposed in a vertical direction in said outdoor installation; a shorter axis of said rectangular cross section defined by a top wall at the top of said conduit and a bottom wall at the bottom of said conduit opposite said top wall; one of said side walls being generally flat and a second of said walls having a bulged area, extending outwardly from said second of said side walls; said bulged area including a flat nailing surface generally parallel to said top wall; said flat nailing surface being horizontal in said outdoor installation; a plurality of openings on said top wall permitting fluid flow therethrough from said top wall into the interior opening of said drainage conduit; and a plurality of lower drain openings located adjacent said bottom of said conduit.

13. The water drainage conduit system of claim 12 wherein said conduit further is defined by a collection trough at said bottom of said conduit for collection of water and debris flowing through said conduit.

14. The water drainage conduit system of claim 13 wherein said lower drain openings are located above said collection trough.

15. The water drainage conduit system of claim 14 wherein said lower drain openings are formed on a lower ledge of said bulged area.

16. The water drainage conduit system of claim 12 wherein said flat nailing surface is characterized as an upper ledge formed on said bulged area.

17. The water drainage conduit system of claim 12 further including an additional series of drain openings located adjacent to and above said upper ledge nailing surface.

* * * * *